US006970139B1

(12) United States Patent
Chew et al.

(10) Patent No.: US 6,970,139 B1
(45) Date of Patent: Nov. 29, 2005

(54) SHORT RESONANT RIDGE WAVEGUIDE LOAD UNDER RADIATION SLOT

(75) Inventors: Richard F. Chew, Ridgecrest, CA (US); Will Freeman, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/875,803

(22) Filed: Jun. 21, 2004

(51) Int. Cl.[7] ..... H01Q 13/00; H01Q 13/10
(52) U.S. Cl. ..... 343/767; 343/772
(58) Field of Search ..... 343/772, 767, 343/771

(56) References Cited

U.S. PATENT DOCUMENTS 3,530,479 A * 9/1970 Waldron ..... 343/771
3,978,485 A * 8/1976 Bonnaval ..... 343/767
4,124,851 A * 11/1978 Aaron et al. ..... 343/772

* cited by examiner

*Primary Examiner*—Hoang V. Nguyen
*Assistant Examiner*—Angela M Lie
(74) *Attorney, Agent, or Firm*—David S. Kalmbaugh

(57) ABSTRACT

A short ridge waveguide load is described which absorbs and cancels non-radiated electromagnetic energy in continuous slot or discrete slotted antennas. The load achieves a small physical size by using a resonant structure which includes an absorbing ferrite front section positioned within the interior of the waveguide antenna below the slot and a back section of ferrite material also positioned in the interior of the waveguide antenna. This allows for energy to be radiated from the slot while absorbing and canceling the non-radiated energy using a relatively small size load. In a rectangular ridge waveguide configuration, the front section consists of a pair of posts having a trapezoidal, rectangular or triangular shape.

25 Claims, 9 Drawing Sheets

SHORT RESONANT RIDGE WAVEGUIDE LOAD UNDER RADIATION SLOT

BACKGROUND OF THE INVENTION

1. Field of the Invention

The present invention relates generally to ridge waveguide antenna loads and often, more particularly, to traveling wave antennas, such as a continuous slot or discrete slotted ridge waveguide antenna which includes a load positioned at the end of the antenna to absorb and cancel the non-radiated energy.

2. Description of the Prior Art

In the past, slotted antennas generally included tapered loads or resonant loads positioned behind the antenna's radiating slot or at the end of the slot. For example, U.S. Pat. No. 3,978,485 to Pierre Bonnaval, which issued Aug. 31, 1976, illustrates a continuous slot antenna having a waveguide closed at one end with a tapered load positioned at the closed end of the waveguide to absorb non-radiated energy. While functioning adequately as an absorptive load to absorb microwave energy, the physical size of the load of U.S. Pat. No. 3,978,485 is relatively long and thus not optimal when the antenna is to be located in a confined space or there are size limitations placed on the antenna.

SUMMARY OF THE INVENTION

The present invention overcomes some of the deficiencies of the past including those mentioned above in that it comprises a relatively simple and extremely effective microwave energy absorptive resonant load for use in a slotted waveguide antenna. The microwave energy absorptive resonant load includes a ferrite resonant front section which is positioned within the interior of the slotted waveguide antenna below the slot and a back section of absorptive ferrite material also positioned in the interior of the slotted waveguide antenna. In a rectangular ridge waveguide configuration, the front section consists of a pair of posts or teeth which are approximately a quarter wavelength long. In the rectangular ridge waveguide configuration, the back section has sufficient length to insure cancellation of a wave propagated into the back section. The reflected waves from the post or teeth in the front section, and the wave that transmits out, that is the wave which is primarily reflected from the back section are of equal magnitude, but are phase shifted by one hundred eighty degrees to insure cancellation of the waves at the plane formed at the front end of the teeth or post of the load.

DETAILED DESCRIPTION OF A PREFERRED EMBODIMENT

Figure 1A:
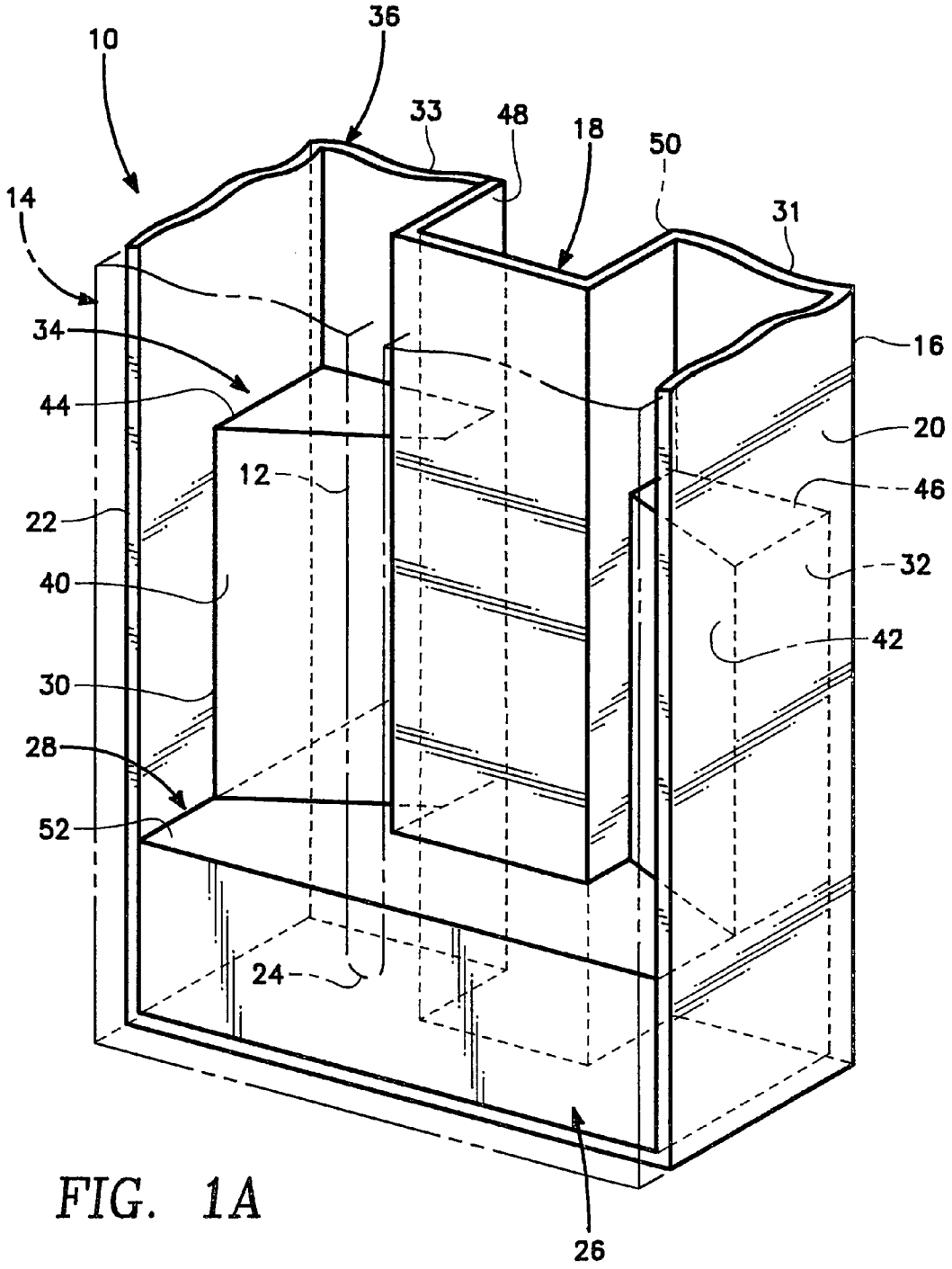
FIGS. 1A, 1B, and 2 are perspective views illustrating a slotted waveguide antenna having an absorptive resonant load positioned within the interior of the waveguide antenna which comprises the present invention.
Figure 1B:
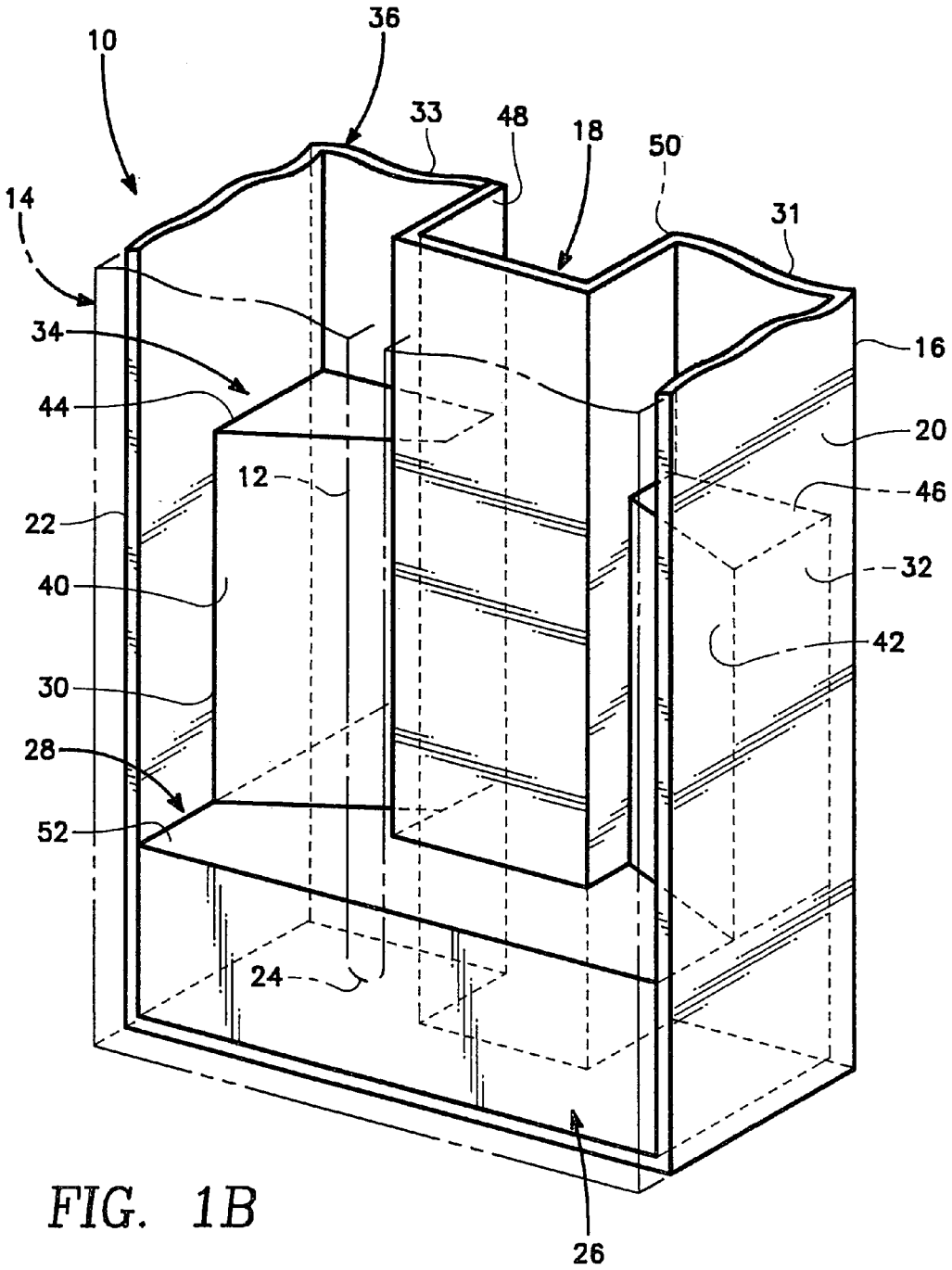
Figure 2:
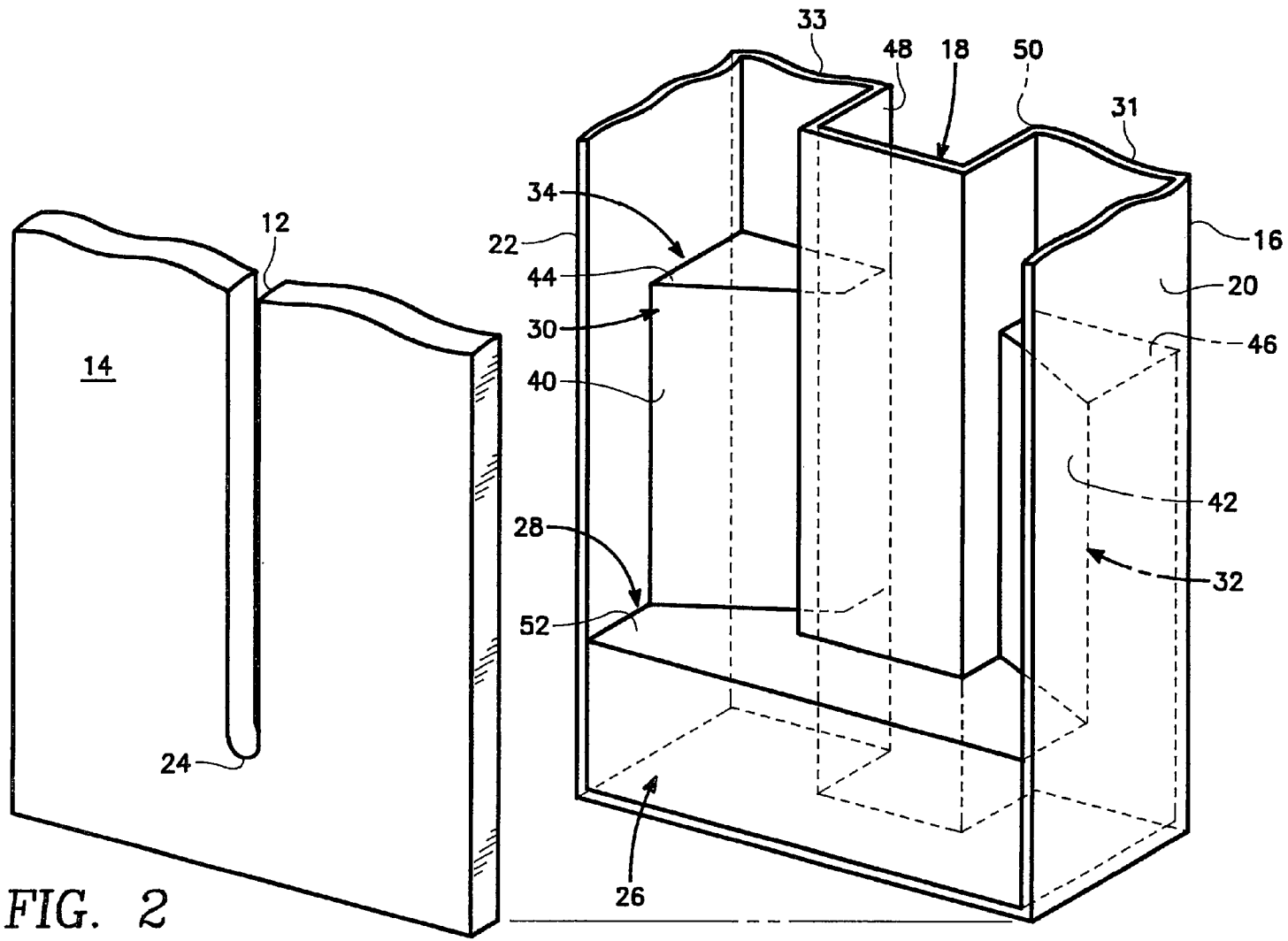

Referring to FIGS. 1A, 1B and 2, there is shown a slotted waveguide antenna 10 consisting of straight slot 12 which runs along the broad or upper face 14 of the waveguide antenna 10. The bottom or lower face 16 of waveguide antenna 10 has a ridge 18 which is generally centrally located within the lower face 16 of waveguide antenna 10, although ridge 18 can be asymmetrical. Ridge 18 runs the length of antenna 10. Waveguide antenna 10 also has a pair of sidewalls 20 and 22 which with upper face 14 and lower face 16 form a rectangular shaped ridge waveguide.

While shown as a flat surface in FIG. 1, the upper face 14 may conform to other geometries such as an upper face having a curved surface. A radome or cover may be placed over upper face 14 and slot 12

Positioned directly under the rear end 24 of slot 12 is the back section 26 of a resonant load 28. Extending forward from the back section 26 of resonant load 28 are a pair of angled posts or teeth 30 and 32 which comprise the front section 34 of the load 28. The angled posts or teeth 30 and 32 of resonant load 28 are positioned within waveguide antenna 10 in the lower portion of the interior 36 of waveguide antenna 10. Angled posts or teeth 30 and 32 respectively have angled surfaces 40 and 42.

Figure 3:
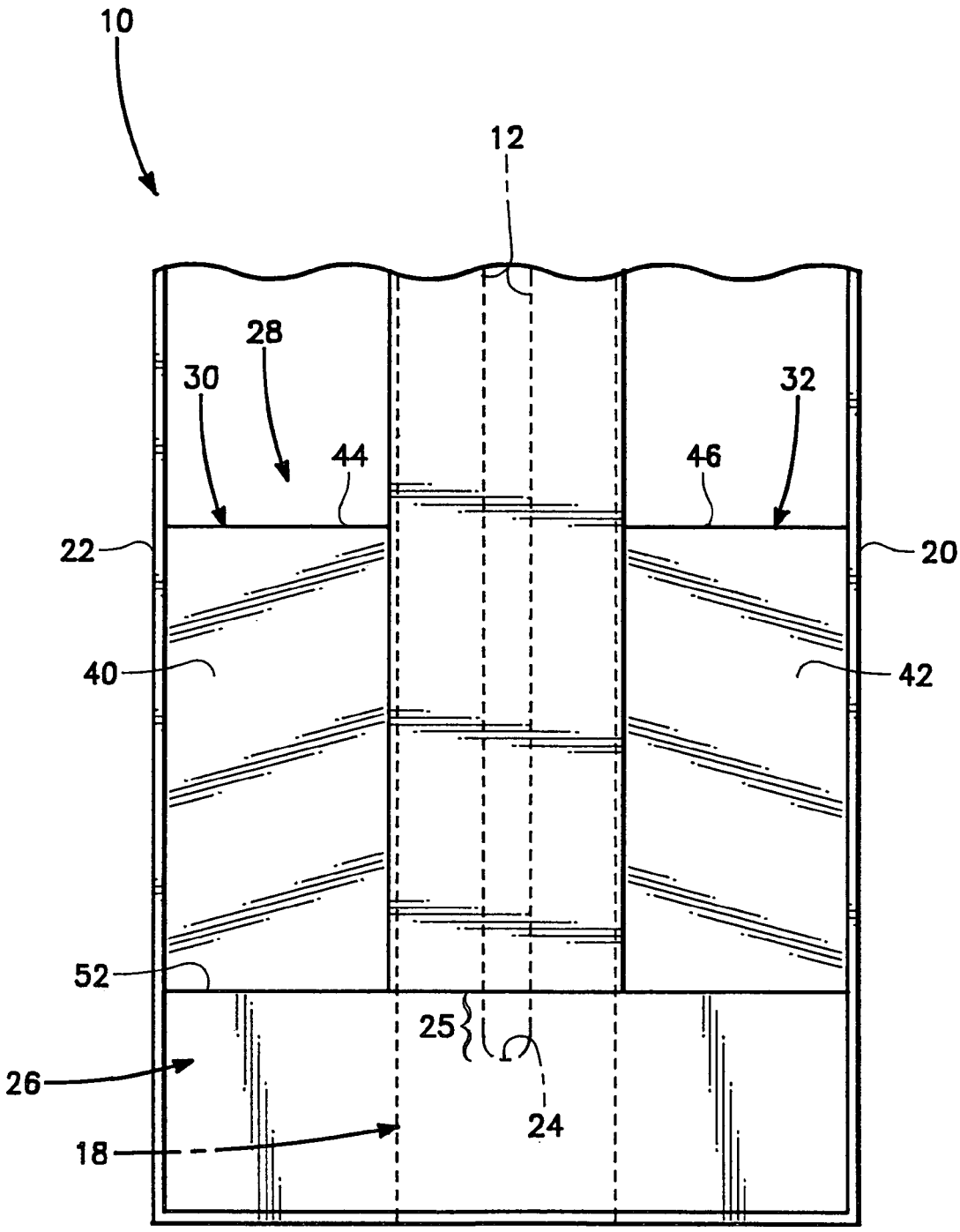
FIGS. 3–4 illustrate various views of the slotted waveguide and absorptive resonant load of FIGS. 1A and 1B.
Figure 4:
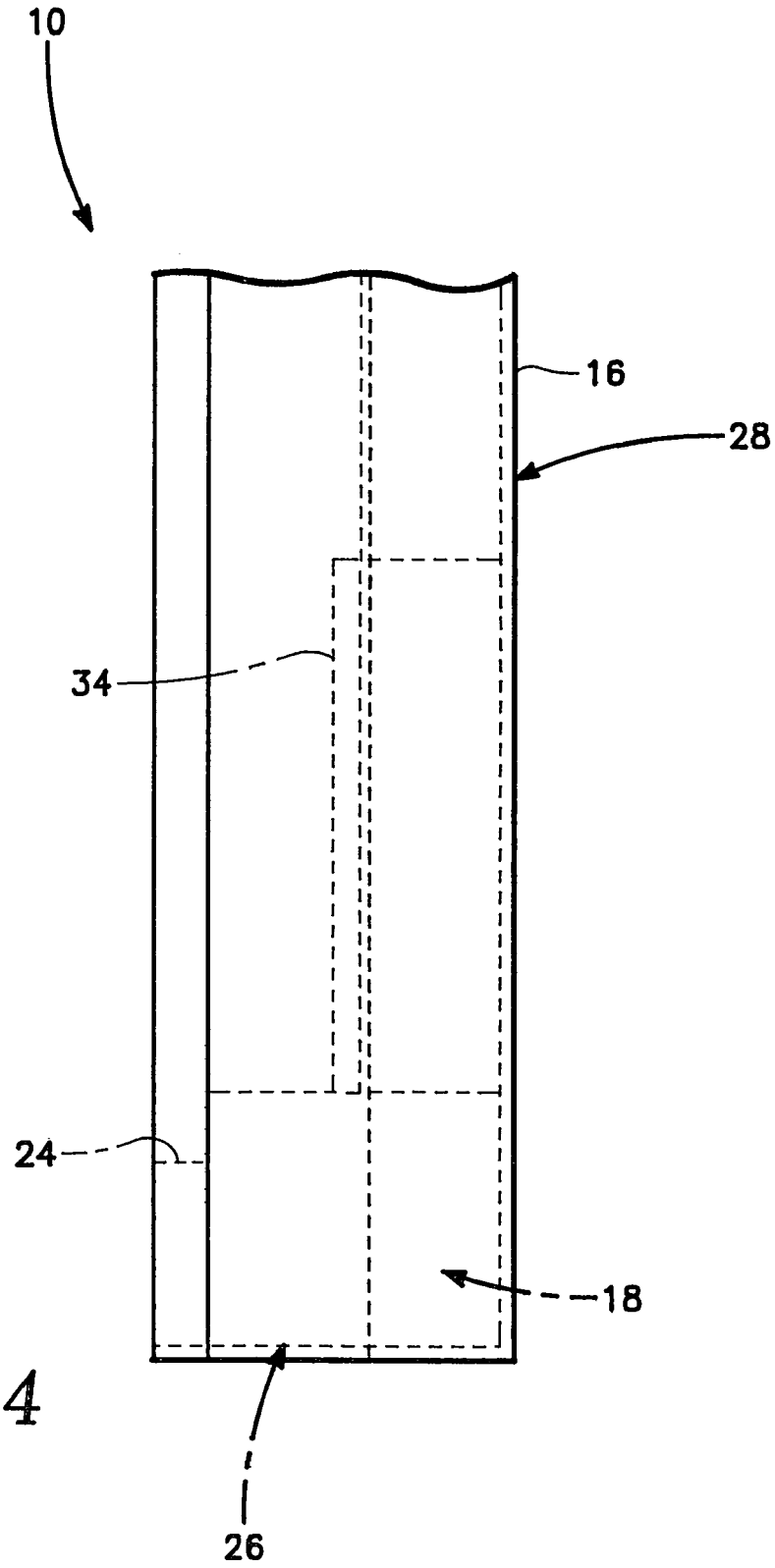

Slot 12 may extend into the back section 26 of resonant load 28 (as shown in FIG. 3) or slot 12 can end prior to the back section 26 of load 28. Further, slot 12 may be either a continuous slot or a discrete slot.

At this time, it should be noted that posts 30 and 32 are positioned respectively in troughs 31 and 33 formed on the opposite sides of ridge 18.

Figure 5A:
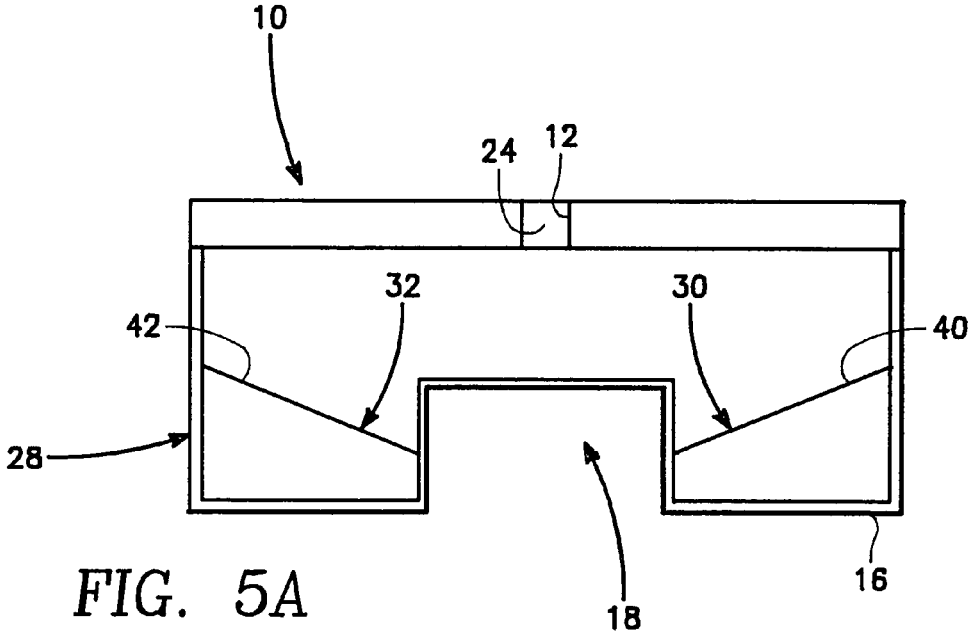
FIGS. 5A, 5B and 5C illustrate three configurations for the teeth/posts of the absorptive resonant load of FIGS. 1A and 1B.
Figure 5B:
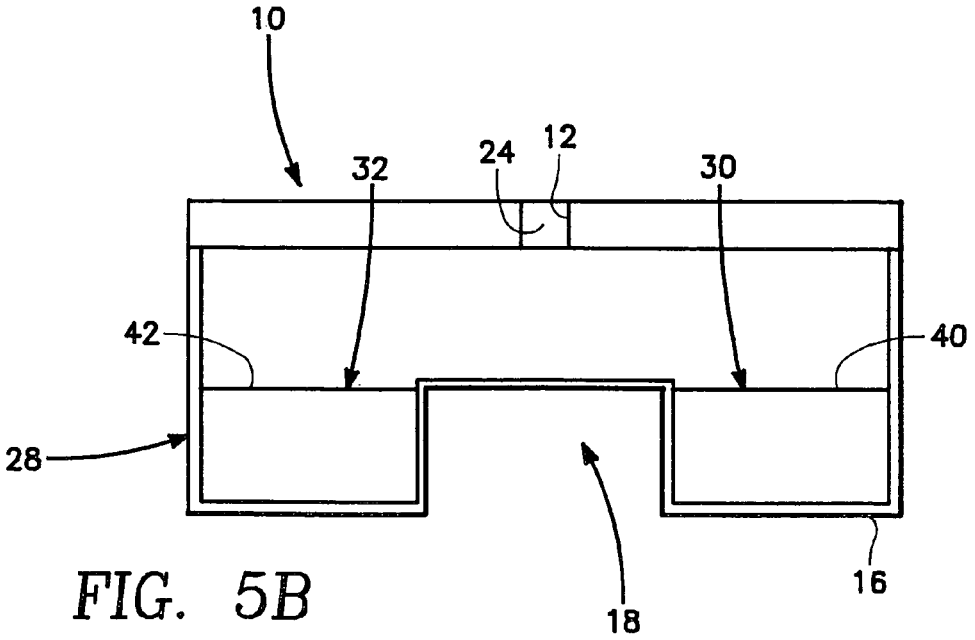
Figure 5C:
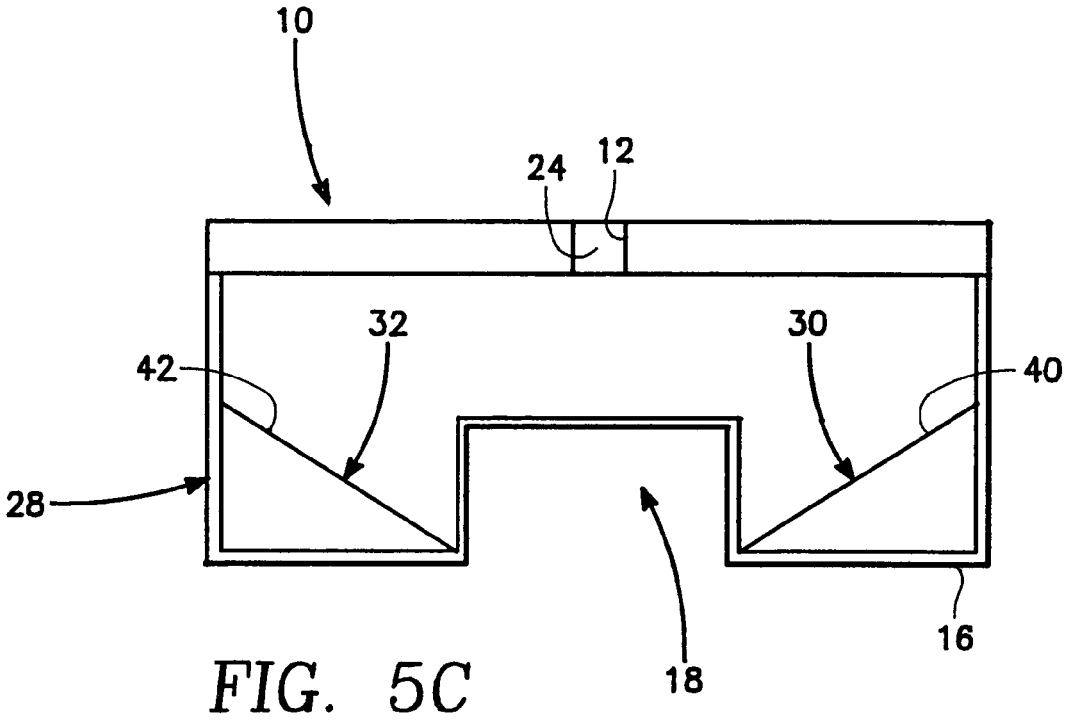

Referring now to FIGS 1A, 1B, 5A, 5B and 5C, the ferrite posts 40 and 42 have a various shapes as is best illustrated in FIGS. 5A, 5B and 5C. In the FIG. 5A each of the ferrite posts 40 and 42 has the shape of trapezoid. In FIG. 5B each of the ferrite posts 40 and 42 has the shape of a rectangle. In FIG. 5C, each of the ferrite posts has the shape of a triangle.

Referring to FIGS. 1A, 1B and 5A, angled surface 40 of post 30 is shaped such that a trapezoid is formed and angled surface 40 extends from approximately the mid-point of side wall 22 to near the upper edge 48 of ridge 18. Post 30 also has a triangular shaped surface 44 which is located at the front end of post 30. Surface 44 of resonant load 28 is positioned vertically within waveguide antenna 10 and is perpendicular to angled surface 40.

Referring again to FIGS. 1B and 5A, angled surface 42 of post 32 is shaped such that a trapezoid post is formed and angled surface 42 extends from approximately the mid-point of side wall 20 to near an upper edge 50 of ridge 18. Post 32 also has a triangular shaped surface 46 which is located at the front end of post 32. Surface 46 of resonant load 28 is positioned vertically within waveguide antenna 10 and is perpendicular to angled surface 42.

The back section 26 of resonant load 2 includes a front surface or wall 52 which is positioned vertically within waveguide antenna 10.

At this time it should be noted the resonant load 28 may be fabricated from commercially available microwave absorbing material, such as a ferrite material.

Referring to FIGS. 1–5, resonant load 28 insures that reflected power is approximately zero, while allowing for electromagnetic radiation from slot 12. This is accomplished by making a wave reflected from the front section 34 of resonant load 28 cancel a wave reflected from the back section 26 of resonant load 28. A portion of the incident wave is reflected from a vertical plane A in the waveguide 10 that includes surface 44 of post 30 and surface 46 of post 32. A portion of the incident wave is transmitted through plane A to the back section 26 of resonant load 28 and is then reflected from a plane B in the waveguide 10 formed by the front surface 52 of rear section 26, returning to plane A.

The total reflection coefficient at plane A for the waves is set forth approximately by the following expression:

$$\Gamma=\Gamma_1+T_{12}\cdot T_{21}\Gamma_3\cdot e^{-2j\cdot\gamma 1-2\cdot\alpha\cdot 1}+T_{12}\cdot T_{21}\cdot\Gamma_3^{\,2}\cdot\Gamma_2\cdot e^{-4j\cdot\gamma\cdot 1-4\cdot\alpha\cdot 1} \quad (1)$$

Region one is in front of plane A, and region two is behind plane A and in front of plane B.

A phase shift of one hundred eighty degrees between the wave reflected from plane A and the wave reflected from an effective plane B that is transmitted through results in a total reflected power of approximately zero when the magnitude of the reflected waves are approximately equal. There is a need to determine the complex propagation constant for the slotted waveguide antenna comprising the present invention using techniques well known in the art.

Cancellation of the reflected waves occurs when the ferrite posts or teeth 30 and 32 are approximately $\lambda_g/4$.

It should be noted that the transmitted wave from reference plane A that reflects from the back of load 28 is radiated by slot 12 and attenuated by the absorbing material of resonant load 28. In order to obtain optimal low return loss, the posts or teeth 30 and 32 are shaped and sized as shown in FIGS. 1 and 2 such that reflected power from the back section 26 of the resonant load 28 that transmits back out through reference plane A is canceled by reflected power from the front section 34 of resonant load 28.

Figure 7:
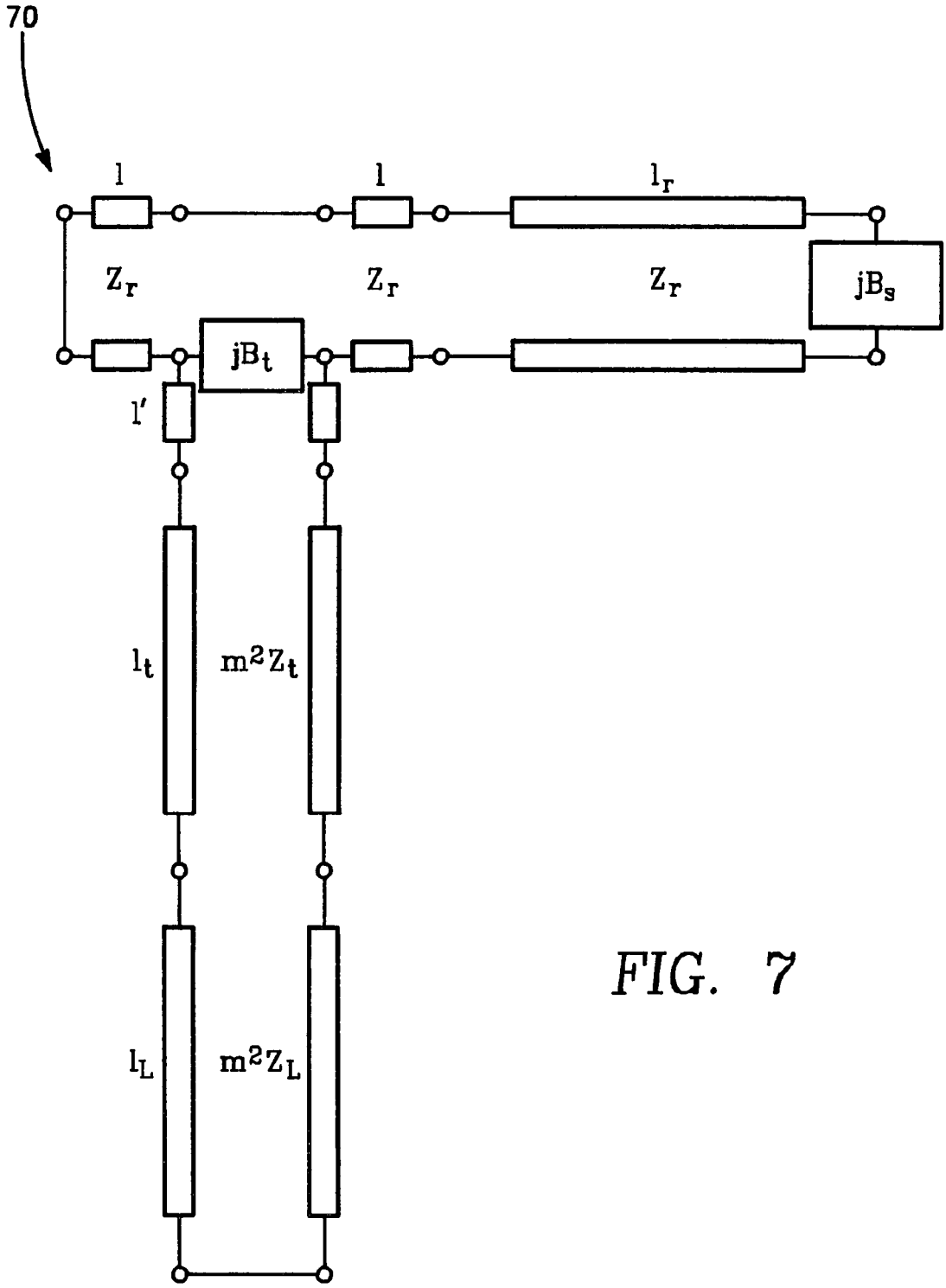
FIG. 7 is an equivalent circuit diagram for the continuous slot waveguide antenna of FIGS. 1A and 1B and 2 for the wave guide mode.
Figure 8:
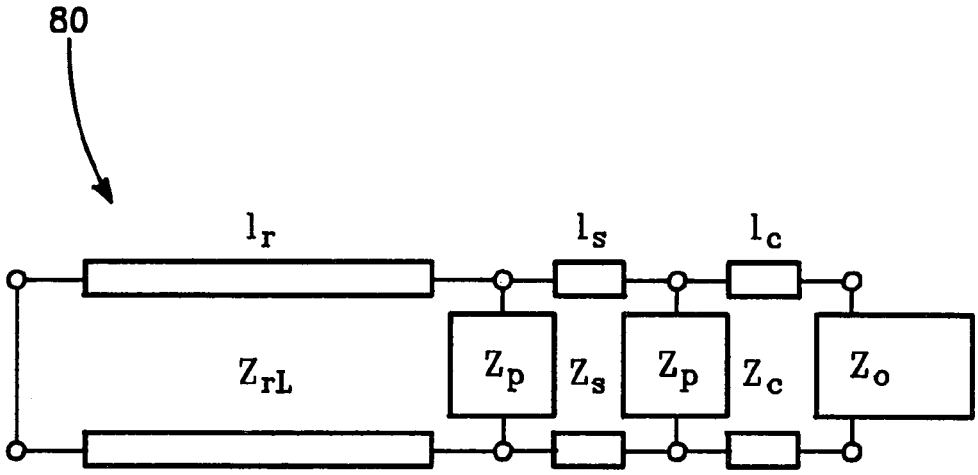
FIG. 8 is an equivalent circuit diagram for the continuous slot waveguide antenna of FIGS. 1A, 1B, and 2 for the slot mode.

Waveguide antenna 10 has two modes. The first mode is the wave guide mode (the equivalent circuit 70 is depicted in FIG. 7) and the second mode is the slot mode (the equivalent circuit 80 is depicted in FIG. 8). As depicted in FIG. 3, an end portion 25 of slot 12 is positioned directly above the back section 26 of resonant load 28 and terminates in a semi-circular tip or other geometry. The ferrite material under end portion 25 of slot 12 attenuates the slot mode energy to provide for an improved radiation pattern from waveguide antenna 10 at and near endfire and reduces cross polarization. The load material can be extended inside the end portion of the slot.

Figure 6:
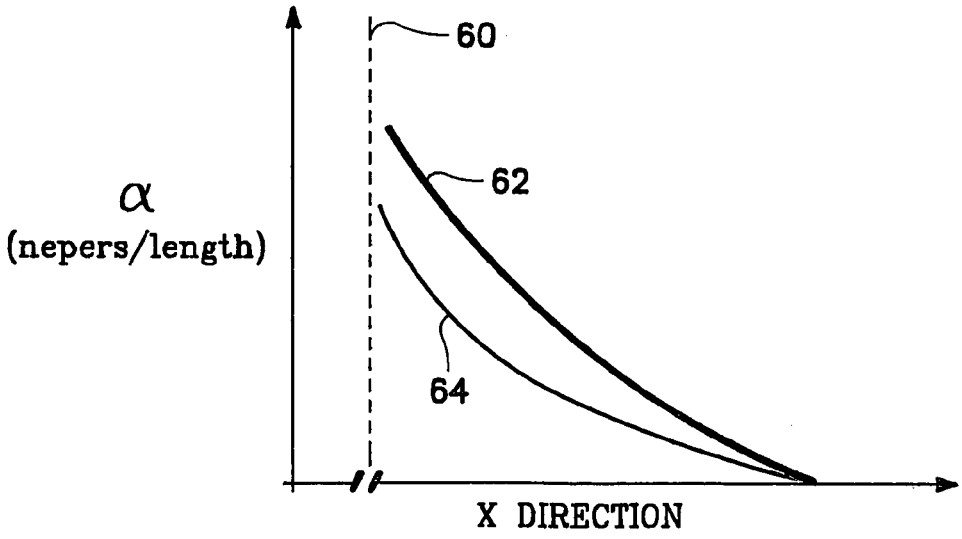
FIG. 6 is a compensation curve for use with the slotted waveguide antenna and absorptive resonant load of FIGS. 1A and 1B.

Referring to FIGS. 1, 2, and 6, when resonant load 28 is used for termination, the slot may be offset from the center of the waveguide and end in the center of the waveguide. Since the post 30 and 32 of the load 28 are under the last part of the slot 12, the power radiated is reduced as compared to how it would be without ferrite material. In order to obtain the desired attenuation, a compensation curve of the type illustrated in FIG. 6 may be utilized. The curve represented by the plot 62 of FIG. 6 is the compensated curve, and the curve represented by the plot 64 of FIG. 6 is the original curve. The dashed line 60 represents the load reference plane which is at plane A.

Further, it should be noted that the ridge 18 in waveguide antenna 10 may be changed to allow for amplitude and phase compensation. This may not yield perfect results do to a standing wave within the resonant load 28. However using the equivalent circuit of FIG. 7, an approximate compensation can be made and since the load is relatively small and at the end of the line source distribution, there is a minimal effect on the antenna pattern and acceptable results are obtained in an optimally short physical length for the load.

Referring to FIGS. 1, 2, 7 and 8, the equations which define ridge waveguide antenna 10 with resonant load 12 are as follows. The intrinsic wave characteristics for ridge waveguide 10 include the intrinsic wave impedance which is given by the following expression:

$$Z_0=\sqrt{\frac{\mu}{\varepsilon}} \quad (2)$$

the wave propagation number which is given by the following expression:

$$k=\omega\sqrt{\mu(\epsilon)} \quad (3)$$

the wave complex propagation constant which is given by the following expression:

$$\gamma=k \quad (4)$$

the wave complex propagation constant which is denoted by $\gamma$, and the wave attenuation constant which is denoted by $\alpha$, where the load material is defined by $\mu$ which is relative permeability; and $\epsilon$ which is the material's dielectric constant The guide characteristics for ridge waveguide 10 are given by the following expressions:

$$\gamma=\sqrt{k_c^{\,2}-k^2} \quad (5)$$

$$\gamma=\alpha+j\gamma \quad (6)$$

$$Z_{TE01}=\frac{j(\omega)(\mu)}{\gamma} \quad (7)$$

where $k_c$ is determined by an equivalent circuit.

The reflection and transmission coefficients at the interfaces are given by the following equations:

$$\Gamma_1=\frac{Z_2-Z_1}{Z_2+Z_1} \quad (8)$$

which is the reflection into region 1 off of region 2 at plane A;

$$\Gamma_2=-\Gamma_1 \quad (9)$$

which is the reflection into region 2 off of region 1 at plane A;

$$T_{21}-1+\Gamma_1 \quad (10)$$

which is the transmission into region 2 from region 1; and $$T_{12}=1+\Gamma_2 \quad (11)$$

which is the transmission into region 1 from region 2.

The total reflection coefficient is approximated by the following expression:

$$\Gamma=\Gamma_1+T_{12}\cdot T_{21}\cdot\Gamma_3\cdot e^{-2j\cdot\gamma 1-2\cdot\alpha\cdot 1}+T_{12}\cdot T_{21}\cdot\Gamma_3^{2}\cdot\Gamma_2\cdot e^{-4j\cdot\gamma 1-4\cdot\alpha\cdot 1} \quad (12)$$

Only the first three terms are shown for the above expression, and only the first two terms are kept for illustration purposes since $e^{-4\cdot\alpha\cdot 1}$ is small. In the above expression the first two terms are set to zero for a match. $\Gamma_3$ is the reflection coefficient off of plane B.

Referring to FIGS. 1 and 7, the equivalent circuit 70 shown in FIG. 7 is for the waveguide mode of waveguide antenna 10. In FIG. 7, $B_s$ is the slot impedance, $Z_r$ is the waveguide impedance over ridge 18, l is the length of a terminal plane shift of ridge 18, $l_r$ is ½ the length of the width of ridge 18, $Z_t$ is the wave guide impedance in the troughs 31 and 33, $B_t$ is the discontinuity impedance or reactance from ridge 18 to the troughs 31 and 33, $l_t$ is the length of the trough width filled with air, $m^2$ is the multiplication ratio of the wave impedance, l' is the length of the terminal plane shift of the troughs 31 and 33, $Z_L$ is the waveguide impedance in the troughs 31 and 33 filled with the load material of load 28, and $l_r$ is ½ the length of the ridge waveguide.

Referring to FIGS. 1 and 8, the equivalent circuit 80 shown in FIG. 8 is for the slot mode of the waveguide antenna 10. In FIG. 8, $Z_c$ is the plane wave impedance of the cover, $l_c$ is the thickness of the cover, $Z_s$ is the parallel plate wave guide impedance of the slot 12, $Z_p$ is the slot opening to space impedance, $l_s$ is the thickness of the slot, $Z_{rL}$ is the plane wave impedance of the lossy material, $l_r$ is the distance from the ridge to the inside of the top wall 16 and s is the slot width.

From the equivalent circuits depicted in FIGS. 7 and 8, power diversion splitting of the two modes is taken into account and $k_c$ and a can be determined. For the purpose of illustrating, the waveguide mode equivalent circuit 70 (FIG. 7) assumes a non-radiating centered slot and the equivalent circuit 80 (FIG. 8) for the mode that rides in the slot is just for the portion over the back of the resonant load 28. An off centered slot for the waveguide mode and the air and the air/ferrite portions for the slot mode can be included in the analysis with modification. Other techniques such as finite element method analysis can also be used. The equivalent circuits may also include a continuous slot for such a design.

At this time it should be noted that the resonant load may be utilized in a double ridge waveguide. It also should be understand that the resonant load may be used in a dielectric filled or a partially dielectric filled ridge waveguide and is not limited to an air filled ridge waveguide.

From the foregoing, it is readily apparent that the present invention comprises a new, unique and exceedingly useful and effective microwave energy absorptive resonant load for use in a continuous slot or discrete slotted antennas which constitutes a considerable improvement over the known prior art. Many modifications and variations of the invention are possible in light of the above teachings. It is therefore to be understood that within the scope of the appended claims that the invention may be practiced otherwise than as specifically described.

What is claimed is:

1. A resonant load for a ridge waveguide antenna, said ridge waveguide antenna having a ridge located on a bottom face thereof and a slot located in an upper face thereof, said resonant load comprising:

(a) a ferrite resonant front section positioned within an interior of said ridge waveguide below said slot;

(b) a ferrite resonate back section positioned in the interior ridge waveguide below an end portion of said slot;

(c) the front section of said resonate load including a a first ferrite post and a second ferrite post, the first ferrite post being positioned on one side of said ridge within the interior of said ridge waveguide and the second ferrite post being positioned on an opposite side of said ridge within the interior of said ridge waveguide;

(d) said resonant load absorbing and canceling microwave energy to provide for an improved electromagnetic radiation pattern wherein a reflected wave from said first and second ferrite post of said resonate load and a wave which is primarily reflected from the back section of said resonant load are of equal magnitude and are phase shifted by one hundred eighty degrees to insure cancellation of one another at a plane formed at the front end of first and second ferrite post.

2. The antenna of claim 1 wherein said first and second ferrite post each have a trapezoidal shape.

3. The antenna of claim 1 wherein said first and second ferrite post each have a rectangular shape.

4. The antenna of claim 1 wherein said first and second ferrite post each have a triangular shape.

5. The antenna of claim 1 wherein said slot is a continuous slot.

6. The antenna of claim 1 wherein said slot is a discrete slot.

7. The antenna of claim 1 wherein said resonant load under the end portion of said slot attenuates slot mode energy to provide for said improved radiation pattern from said ridge waveguide antenna and reduce cross polarization.

8. The antenna of claim 7 wherein the resonant load extends inside the end portion of said slot.

9. The antenna of claim 1 wherein said improved electromagnetic radiation pattern is a result of attenuating a slot mode and is achieved with a substantially reduced length for said resonant load and said ridge waveguide.

10. A ridge waveguide antenna having a resonant load to provide for an improved electromagnetic radiation pattern comprising:

(a) a generally rectangular shaped ridge waveguide having a ridge located on a bottom face of said ridge wavelength;

(b) a slot located in an upper face of said ridge waveguide, said slot having a length approximating the length of said ridge waveguide;

(c) said resonate load being positioned in an interior of said ridge waveguide to absorb and cancel microwave energy, said resonate load having a ferrite resonant front section which is positioned within the interior of said ridge waveguide below said slot and a ferrite resonate back section positioned in the interior ridge waveguide below an end portion of said slot; and (d) the front section of said resonate load including a pair of ferrite post, a first of said pair of ferrite post being positioned on one side of said ridge within the interior of said ridge waveguide and a second of said pair of ferrite post being positioned on an opposite side of said ridge within the interior of said ridge waveguide.

11. The antenna of claim 10 wherein said pair of ferrite post each have a trapezoidal shape.

12. The antenna of claim 10 wherein said pair of ferrite post each have a rectangular shape.

13. The antenna of claim 10 wherein said pair of ferrite post each have a triangular shape.

14. The antenna of claim 10 wherein said back section of said resonate load completely fills the interior of said ridge waveguide antenna below the end portion of said slot.

15. The antenna of claim 10 wherein said slot is a continuous slot.

16. The antenna of claim 10 wherein said slot is a discrete slot.

17. The antenna of claim 10 wherein said improved electromagnetic radiation pattern is a result of attenuating a slot mode and is achieved with a substantially reduced length for said resonant load and said ridge waveguide.

18. The antenna of claim 10 wherein a reflected wave from the pair of ferrite post of said resonate load and a wave which is primarily reflected from the back section of said resonant load are of equal magnitude and are phase shifted by one hundred eighty degrees to insure cancellation of one another at a plane formed at the front end of the pair of ferrite post of said resonate load.

19. The antenna of claim 10 wherein said resonant load under the end portion of said slot attenuates slot mode energy to provide for said improved radiation pattern from said ridge waveguide antenna and reduce cross polarization.

20. The antenna of claim 19 wherein the resonant load extends inside the end portion of said slot.

21. A ridge waveguide antenna having a resonant load to provide for an improved electromagnetic radiation pattern comprising:

(a) a generally rectangular shaped ridge waveguide having a ridge centrally located on a bottom face of said ridge wavelength;

(b) a slot located in an upper face of said ridge waveguide, said slot having a length approximating the length of said ridge waveguide;

(c) said resonate load being positioned in an interior of said ridge waveguide to absorb and cancel microwave energy, said resonate load having a ferrite resonant front section which is positioned within the interior of said ridge waveguide below said slot and a ferrite resonate back section positioned in the interior ridge waveguide below an end portion of said slot; and (d) the front section of said resonate load including a a first ferrite post and a second ferrite post, the first ferrite post being positioned on one side of said ridge within the interior of said ridge waveguide and the second ferrite post being positioned on an opposite side of said ridge within the interior of said ridge waveguide, said first ferrite post and said second ferrite post having a shape which approximates a trapezoid, wherein a reflected wave from said first and second ferrite post of said resonate load and a wave which is primarily reflected from the back section of said resonant load are of equal magnitude and are phase shifted by one hundred eighty degrees to insure cancellation of one another at a plane formed at the front end of first and second ferrite post; and (e) the back section of said resonant load completely filling the interior of said ridge waveguide antenna below the end portion of said slot.

22. The antenna of claim 21 wherein said slot is a continuous slot.

23. The antenna of claim 21 wherein said resonant load under the end portion of said slot attenuates slot mode energy to provide for said improved radiation pattern from said ridge waveguide antenna and reduce cross polarization.

24. The antenna of claim 19 wherein the resonant load extends inside the end portion of said slot.

25. The antenna of claim 22 wherein said improved electromagnetic radiation pattern is a result of attenuating a slot mode and is achieved with a substantially reduced length for said resonant load and said ridge waveguide.

* * * * *